United States Patent [19]

Halbert

[11] Patent Number: 5,060,893

[45] Date of Patent: Oct. 29, 1991

[54] APPARATUS AND METHOD FOR HOLDING A BAG OPEN

[76] Inventor: Terrell R. Halbert, 200 W. Parkland, Yukon, Okla. 73099

[21] Appl. No.: 583,497

[22] Filed: Sep. 17, 1990

[51] Int. Cl.[5] ..... A63B 55/04

[52] U.S. Cl. ..... 248/97; 248/99

[58] Field of Search ..... 248/97, 99, 95, 98, 248/101, 100, 151, 163.2, 434; 220/404; 141/314, 391; 226/59

[56] References Cited

U.S. PATENT DOCUMENTS

| | | | |
|---|---|---|---|
| 1,653,393 | 12/1927 | Cox . | |
| 2,731,184 | 1/1956 | Thurber, Jr. | 226/59 |
| 3,627,242 | 12/1971 | Vandermast | 248/97 |
| 3,722,561 | 3/1973 | O'Leary et al. | 141/316 |
| 3,905,406 | 9/1975 | Cruse | 141/390 |
| 3,915,329 | 10/1975 | Zaks | 220/65 |
| 3,934,803 | 1/1976 | Paulus, Jr. | 248/99 |
| 4,006,928 | 2/1977 | Beugin | 294/1.1 |
| 4,037,778 | 7/1977 | Boyle | 229/55 |
| 4,157,801 | 6/1979 | Elmer | 248/97 |
| 4,268,081 | 5/1981 | Hawkinson | 294/55 |
| 4,440,430 | 4/1984 | Kruse | 294/1.1 |
| 4,899,967 | 2/1990 | Johnson | 248/97 |
| 4,901,959 | 2/1990 | Stage | 248/97 |

*Primary Examiner*—Ramon O. Ramirez

*Attorney, Agent, or Firm*—Laney, Dougherty, Hessin & Beavers

[57] ABSTRACT

An apparatus for holding a bag open, and preferably upright, includes a support from which a plurality of legs extend in an outwardly flaring direction. The outwardly flaring legs bias the bag to open to its widest, and they support the bag along its length. A related method is also disclosed.

7 Claims, 1 Drawing Sheet

APPARATUS AND METHOD FOR HOLDING A BAG OPEN

BACKGROUND OF THE INVENTION

This invention relates generally to apparatus and methods for holding a bag open. In a particular aspect, the invention relates to an apparatus and method for holding a bag both open and upright.

Bags which are unable to remain open and upright on their own are used daily for housekeeping and yard maintenance chores, for example. Plastic trash bags in particular have a wide variety of uses, one example of which is for containing leaves or grass cuttings collected during yard maintenance. It is difficult for one person to use these bags unless they are somehow supported.

Such bags can be held open by either external or internal holding devices. Examples of external devices are a conventional metal or plastic trash can or some type of outer framework. Internal devices include inner frames or inner structures which are received inside a bag to support it.

Although various types of both external and internal devices have been disclosed, there is the need for a device which fully opens the bottom seam of the bag and which allows the bag to expand to its full volume as contents are added to the bag. Such a device should also be readily removable from the bag when it is full. These features will allow the bag to be used so that there is little or no wasted bag volume.

SUMMARY OF THE INVENTION

The present invention meets the aforementioned needs by providing a novel and improved apparatus and method for holding a bag open and, preferably, upright. The present invention fully opens the bottom seam of a bag and it allows the bag to expand as contents are added to the bag, but the apparatus of the invention can be readily removed when the bag is full.

In general, the present invention provides an apparatus for holding a bag open, comprising: means for supporting an end of a bag; and means, connected to the supporting means, for biasing the other end of the bag outwardly. In a preferred embodiment, the apparatus comprises: a support; and a plurality of legs connected to the support so that the legs flare outwardly as they extend from the support to respective free ends.

The present invention provides a method of holding a bag open and upright, comprising: moving the free ends of a plurality of connected, normally outwardly flaring resilient legs inwardly towards each other; inserting the legs with the moved free ends into a bag so that the moved free ends are at the bottom of the bag; and releasing the free ends of the legs so that the legs tend to return to their normally outwardly flaring shape, wherein the free ends of the legs open the bottom of the bag to its widest.

Therefore, from the foregoing, it is a general object of the present invention to provide a novel and improved apparatus and method for holding a bag open. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

The present invention provides an apparatus for holding a bag open, comprising means for supporting an end of a bag; and means, connected to the supporting means, for biasing the other end of the bag outwardly. Preferably, this biasing means opens the other end of the bag wider than the end of the bag supported by the supporting means. Thus, this tends to fully open the bottom seam of the bag when such "other end" of the bag is the bottom end. This also enables the apparatus to be readily used to hold bags of differing size (typically, but not necessarily exclusively, ones at least as wide as the supporting means). In the preferred embodiment, this biasing means includes means for supporting the bag along its length from the one end to the other end. In the preferred embodiment, these means are implemented by the framework shown in FIGS. 1–4.

Figure 1:
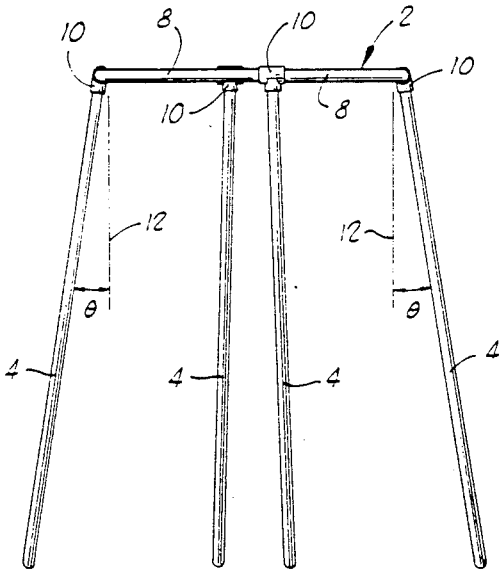
FIG. 1 is a side elevational view of a preferred embodiment of the apparatus of the present invention.
Figure 2:
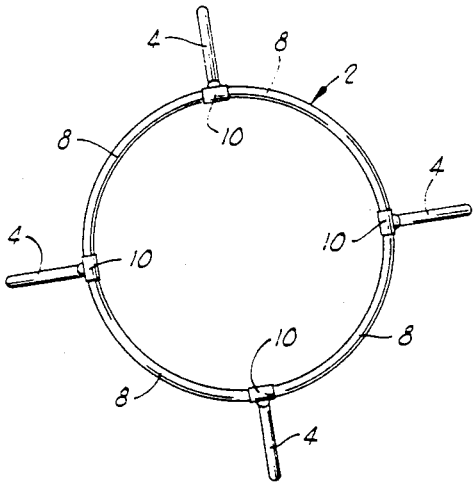
FIG. 2 is a top plan view of the preferred embodiment shown in FIG. 1.

Referring initially to FIGS. 1 and 2, the framework includes a support 2 and a plurality of legs 4. In the preferred embodiment, the support 2 supports the mouth of a bag 6 (see FIG. 4). The support 2 also provides a supporting connection for the legs 4.

The support 2 is preferably a planar circular plastic member, but other constructions and configurations can be used. As shown in the drawings, the support 2 of the preferred embodiment is made as a closed loop of tubular plastic members. There are four curved plastic tubes 8 connected in a known manner by four plastic T-shaped joint members 10.

Each of the legs 4 connects to a respective T-member 10 of the support 2 so that the legs 4 flare outwardly as they extend from the support to their free ends. The legs 4 are connected to provide an outward biasing to the bag 6, and preferably to the bottom of the bag 6. The legs 4 also support the bag 6 along its length.

There are preferably at least three legs. The illustrated preferred embodiment has four legs 4. In general, there should be enough legs to support the bag, but not so many that the legs prevent the contents of the bag from filling against the side of the bag to expand it to its fullest. There also should not be so many legs that it becomes hard to pull the apparatus out of the bag when desired, such as when the bag is full.

In the illustrated embodiment, the four legs 4 are straight resilient tubular plastic members connected at equidistantly spaced locations around the support 2. The legs of the preferred embodiment are normally straight as illustrated, but the legs can be other shapes if desired. For the illustrated embodiment, more important than simply the shape of the legs 4 is that the free ends of the legs extend outwardly from the support 2 so that the distance across the free ends is greater than the distance across the support 2. This allows the support 2, and the legs 4 when they are bent inwardly to positions at or inside a projection of the outer perimeter of the support 2, to fit easily inside the bag to be supported; and yet this allows the legs, upon releasing them, to extend outwardly to force the bag to its maximum or widest open extent.

In the illustrated preferred embodiment, the outward flare of the legs is defined by extending each leg 4 from the support 2 at an acute angle Θ to a respective reference 12 which is perpendicular to the plane of the support 2. Any suitable acute angle may be used, one example of which is 10° for the angle Θ shown in FIG. 1 as the included angle between each leg 4 and its respective reference 12. This outward taper also creates a support for the bag along the length of the bag from its bottom to its mouth.

Figure 3:
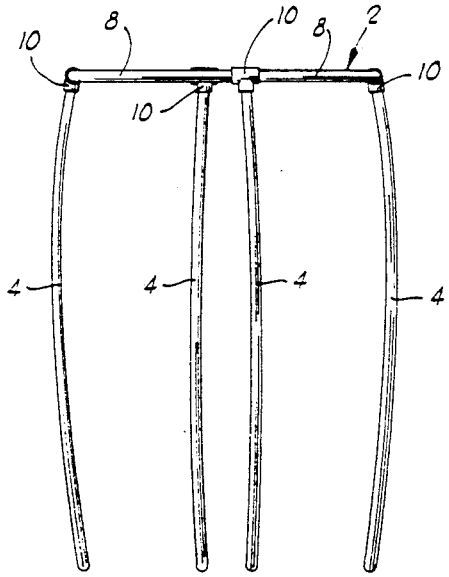
FIG. 3 is a side elevational view showing the free ends of the legs moved inwardly towards each other in a position for receiving a bag to be supported.
Figure 4:
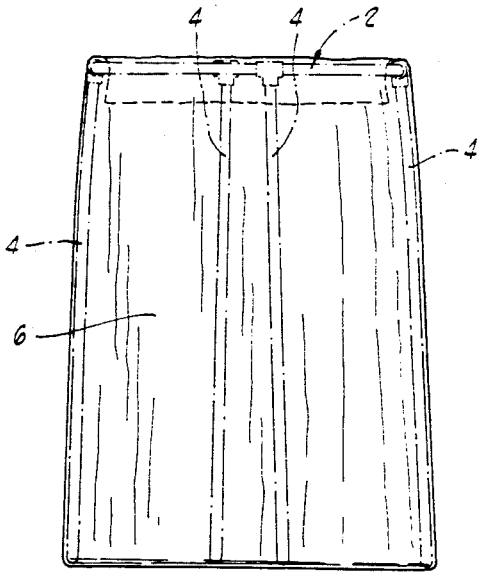
FIG. 4 is a side elevational view showing the preferred embodiment apparatus supporting a bag.

The legs 4 of the preferred embodiment are resilient and are connected to the support 2 so that the legs 4 can be deformed inwardly towards (and possibly inside) their respective references 12 in response to inward deforming forces applied to the legs 4 to move the free ends of the legs 4 to a bag receiving position as illustrated in FIG. 3. Because of such resilience, the legs 4 move outwardly away from the respective references 12 to a bag expanding and supporting position when the inward deforming forces are released. This allows the free ends of the legs to exert a force at the bottom of the bag 6 to maintain the bottom of the bag 6 at its widest open extent as illustrated in FIG. 4.

As is apparent from the foregoing, to hold a bag open and upright with the illustrated apparatus, the free ends of the connected, normally outwardly flaring resilient legs 4 are moved inwardly towards each other as illustrated in FIG. 3. The legs 4 with the inwardly moved free ends are inserted into the bag 6 so that the moved free ends are at the bottom of the bag 6. The free ends of the legs 4 are released so that the legs 4 tend to return to their normally outwardly flaring shape, wherein the free ends of the legs 4 open the bottom of the bag 6 to its widest as shown in FIG. 4. The top of the bag 6 can be wrapped over the support 2 as also illustrated in FIG. 4. Although the invention is preferably intended to be used in the position shown in the drawings wherein the outward flaring occurs from top to bottom, the apparatus can be used in an inverted position wherein the outward flare is at the top.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for holding a bag open, which bag has an open end and a closed end, said apparatus comprising:

means for supporting the open end of the bag, said supporting means having a distance thereacross; and a plurality of resilient deformable biasing means, connected to said supporting means, for biasing from inside the bag the closed end of the bag outwardly so that said plurality of biasing means open the closed end of the bag across a distance

2. An apparatus for holding a bag open as defined in claim 1, wherein said biasing means include means for supporting the bag along its length from the open end to the closed end.

3. An apparatus for holding a bag open, which bag has an open end and a closed end, said apparatus comprising:

means for supporting the open end of the bag, said supporting means having a distance thereacross; and means, connected to said supporting means, for biasing from inside the bag the closed end of the bag outwardly so that said biasing means opens the closed end of the bag across a distance greater than the distance across said support means, wherein said biasing means includes a plurality of legs connected to said support means so that said legs flare outwardly as they extend from said support means to respective free ends.

4. An apparatus for holding a bag open as defined in claim 3, wherein:

said support means includes a circular plastic member; and said plurality of legs include four straight resilient plastic members connected to said circular plastic member.

5. An apparatus for holding a bag open and upright, comprising:

a planar support; and at least three normally straight legs connected to said support so that each leg extends from said support to a free end of the leg at an acute angle to a respective reference which is perpendicular to the plane of said support, said legs being resilient so that in response to inward deforming forces said legs deform inwardly toward the respective references to move the free ends of said legs to a bag receiving position, and so that in response to release of the inward deforming forces said legs move outwardly away from the respective references to a bag expanding and supporting position wherein the free ends of said legs exert a force at the bottom of a received bag to maintain the bottom of the bag open to its widest.

6. An apparatus for holding a bag open and upright as defined in claim 5, wherein:

said support includes a closed loop tubular plastic member; and said legs include tubular plastic members connected at equidistantly spaced locations of said closed loop tubular plastic member.

7. An apparatus for holding a bag open and upright, comprising:

moving inwardly towards each other a plurality of free ends of a respective plurality of resilient legs which normally flare downwardly and outwardly from an upper support to which ends of the legs opposite the free ends are connected;

inserting the legs with the inwardly moved free ends into a bag so that the inwardly moved free ends are at the bottom of the bag; and releasing the free ends of the legs so that the legs tend to automatically return to their normally outwardly flaring shape, wherein the free ends of the legs open the bottom of the bag to its widest.

* * * * *

UNITED STATES PATENT AND TRADEMARK OFFICE

CERTIFICATE OF CORRECTION

PATENT NO. : 5,060,893

DATED : October 29, 1991

INVENTOR(S) : Terrell R. Halbert

It is certified that error appears in the above-identified patent and that said Letters Patent is hereby corrected as shown below:

Column 3, line 66, after "distance", add --greater than the distance across said supporting means.--.

Column 4, line 52, after "7.", delete "An apparatus" and insert --A method--.

Signed and Sealed this

Second Day of March, 1993

*Attest:*

STEPHEN G. KUNIN

*Attesting Officer*

*Acting Commissioner of Patents and Trademarks*